US007248139B1

(12) United States Patent
Podlisk et al.

(10) Patent No.: US 7,248,139 B1
(45) Date of Patent: Jul. 24, 2007

(54) HIGH-CURRENT ELECTRICAL COIL CONSTRUCTION

(75) Inventors: Ilia Podlisk, Nazareth Ilit (IL); George Rucareanu, Nesher (IL)

(73) Assignee: Nemic-Lambda Ltd., Carmiel (IL)

( * ) Notice: Subject to any disclaimer, the term of this patent is extended or adjusted under 35 U.S.C. 154(b) by 0 days.

(21) Appl. No.: 11/341,559

(22) Filed: Jan. 30, 2006

(51) Int. Cl.
*H01F 27/28* (2006.01)

(52) U.S. Cl. ..... 336/232

(58) Field of Classification Search ..... 336/65, 336/83, 185–187, 195–196, 232
See application file for complete search history.

(56) References Cited

U.S. PATENT DOCUMENTS 2,947,960 A * 8/1960 Fredrickson ..... 336/212
3,535,666 A * 10/1970 Bell ..... 336/192
4,295,071 A * 10/1981 Kaspar ..... 310/213
4,847,583 A * 7/1989 Bernard ..... 336/84 C

* cited by examiner

*Primary Examiner*—Tuyen T. Nguyen

(57) ABSTRACT

A high-current electrical coil includes a plurality of flat, electrically-conductive strips bent to define together a coil in which the electrically-conductive strips are disposed coaxially and extend longitudinally with respect to the longitudinal axis of the coil. Each of the electrically-conductive strips is bent to define at least a part of a turn of the coil. One electrically-conductive strip has an outer end carrying a first connector terminal for the coil and projecting outwardly of the coil; and another electrically-conductive strip has an outer end carrying a second connector terminal for the coil and projecting outwardly of the coil. Each of the electrically-conductive strips includes inner ends in electrical continuity with each other, and intermediate portions electrically-insulated from each other such that the plurality of electrically-conductive strips together define a coil exceeding one turn between the first and second connector terminals.

19 Claims, 6 Drawing Sheets

HIGH-CURRENT ELECTRICAL COIL CONSTRUCTION

FIELD AND BACKGROUND OF THE INVENTION

The present invention relate to electrical coils, and particularly to electrical coils constructed so as to have a high-current capacity for use in power equipment, such as inductors, transformers and the like.

Electrical coils are conventionally made by winding insulated wire or flat strips into coils of the desired number of turns. However, as the current-carrying capacity of the coil increases, the cross-sectional area of the wire or strip must be correspondingly increased, which not only increases the weight and size of the coil, but also increases the difficulty and force required in winding the coil. Such conventional coils, therefore, are not only heavy and bulky, but also are expensive to produce.

OBJECT AND BRIEF SUMMARY OF THE PRESENT INVENTION

An object of the present invention is to provide an electrical coil of high current-carrying capacity having advantages in the above respects.

According to one aspect of the present invention, there is provided a high-current electrical core, comprising: a plurality of flat, electrically-conductive strips bent to define together a coil in which the electrically-conductive strips are disposed coaxially, extend longitudinally, and are spaced radially from each other, with respect to the longitudinal axis of the coil; each of the electrically-conductive strips being bent to define at least a part of a turn of the coil; a first one of the electrically-conductive strips having an outer end carrying a first connector terminal for the coil and projecting outwardly of the coil; a second one of the electrically-conductive strips having an outer end carrying a second connector terminal for the coil and projecting outwardly of the coil; each of the first and second electrically-conductive strips including inner ends in electrical continuity with each other, and intermediate portions electrically-insulated from each other such that the plurality of electrically-conductive strips together define a coil exceeding one turn between the first and second connector terminals.

Several embodiment of the invention are described below for purposes of an example. According to further features in the described preferred embodiments, the electrical coil further comprises electrically-conductive fasteners extending through the inner ends of the first and second electrically-conductive strips to enhance the electrical continuity between the inner ends thereof. Also, each of the first and second electrically-conductive strips is formed with mounting legs depending from the end thereof opposite to that carrying the respective connector terminal.

According to still further features in the described preferred embodiments, the plurality of electrically-conductive strips are bent to define a polygon of equal sides. One side of one of the electrically-conductive strips is formed with a gap defining first and second conductive sections on opposite sides of the gap; the first conductive section being integrally formed with one of the connector terminals of the coil; the second conductive section being in electrical continuity with the other electrically conductive strip carrying the other connector terminal of the coil.

Two embodiments are described below wherein the plurality of electrically-conductive strips include only the first and second electrically-conductive strips. In one described embodiment, the coil is constituted of 1.5 turns; and in the other, it is constituted of 2.0 turns.

A further embodiment is described below wherein the plurality of electrically-conductive strips further include at least one intermediate electrically-conductive strip coaxially disposed between the first and second electrically-conductive strips, the intermediate electrically-conductive strip having opposite ends in electrical continuity with the inner ends of the first and second electrically-conductive strips, and an intermediate portion electrically insulated from the first and second electrically-conductive strips. In that described embodiment each of the first and second electrically-conductive strips is bent to define a complete turn of the coil, and the intermediate electrically-conductive strip is bent to define a half-turn of the coil, such that the coil includes 2.5 turns.

While the preferred embodiments of electrical coils described below include 1.5 turns, 2.0 turns and 2.5 turns, respectively, it will be appreciated that electrical coils can be constructed in accordance with the present invention of a larger number of turns by merely including the appropriate number of intermediate electrically-conductive strips and electrically-insulative strips to insulate adjacent electrically-conductive strips. Further features of the invention will apparent from the description below.

BRIEF DESCRIPTION OF THE DRAWINGS

The invention is herein described, by way of example only, with reference to the accompanying drawings, wherein.

It is to be understood that the foregoing drawings, and the description below, are provided primarily for purposes of facilitating understanding the conceptual aspects of the invention and possible embodiments thereof, including what is presently considered to be a preferred embodiment. In the interest of clarity and brevity, no attempt is made to provide more details than necessary to enable one skilled in the art, using routine skill and design, to understand and practice the described invention. It is to be further understood that the embodiments described are for purposes of example only, and that the invention is capable of being embodied in other forms and applications than described herein.

DESCRIPTION OF PREFERRED EMBODIMENTS

Figure 1:
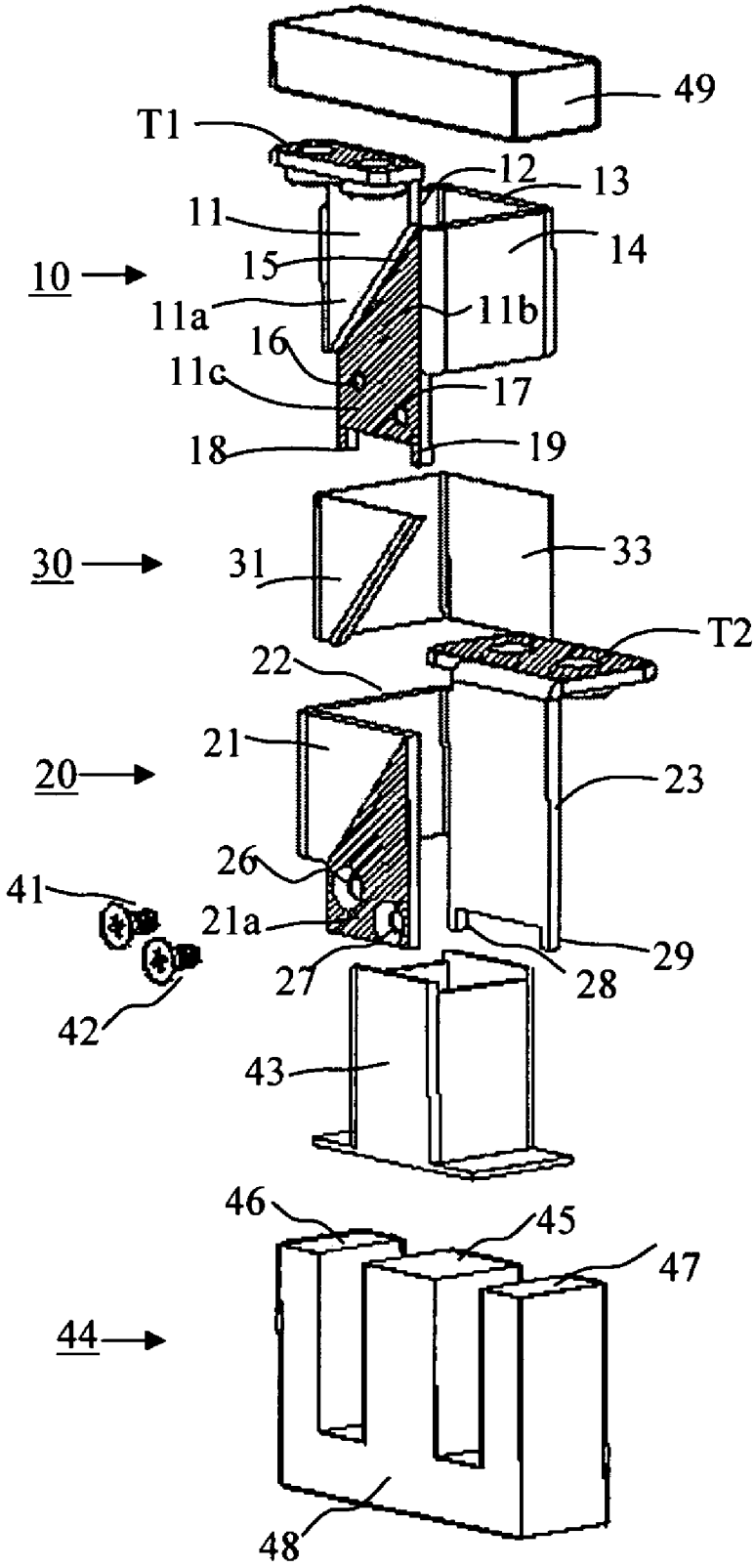
FIG. 1 is an exploded three-dimensional view illustrating a 1.5 turn electrical coil constructed in accordance with the present invention.
Figure 2:
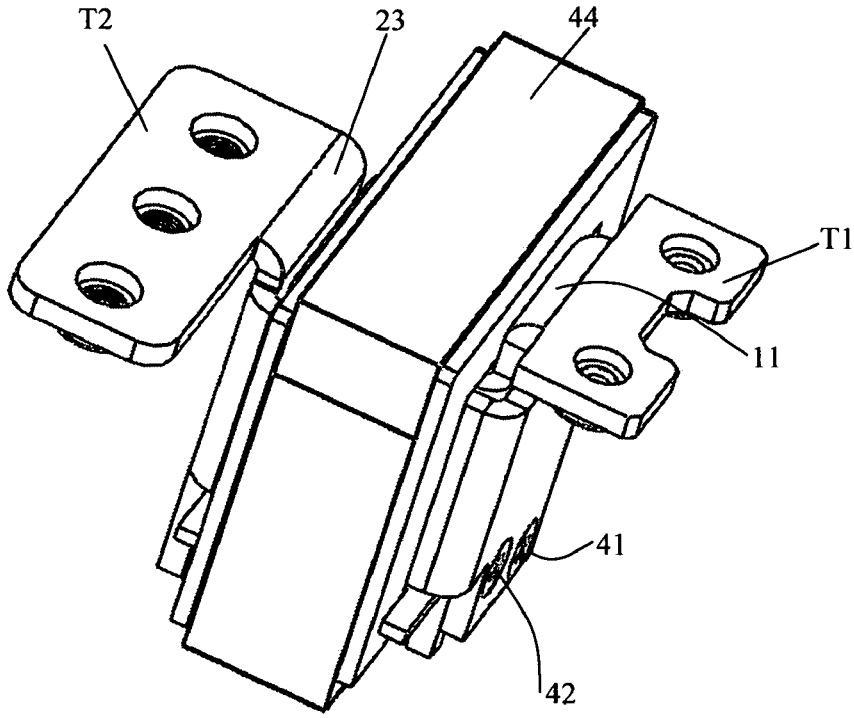
FIG. 2 is a perspective view illustrating the electrical coil of FIG. 1 in assembled form.
Figure 3:
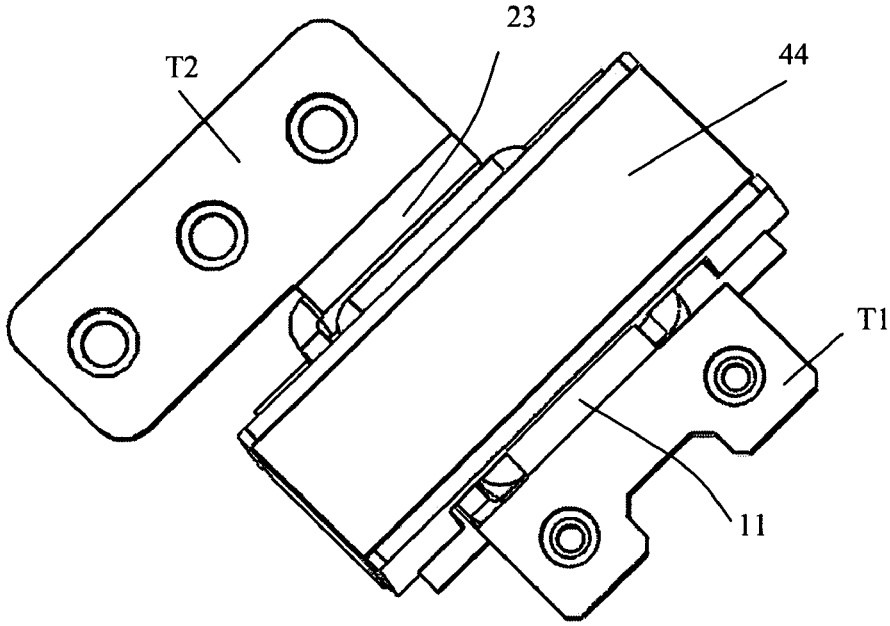
FIG. 3 is a top plan view of the coil of FIG. 2.

The 1.5 Turn Coil of FIGS. 1–3

FIGS. 1–3 illustrate a high-current electrical coil of 1.5 turns constructed in accordance with the present invention. In this case, there are but two flat, electrically-conductive strips, designated 10 and 20 respectively, bent to define together the 1.5 turn coil. The two electrically-conductive strips 10, 20 are disposed coaxially, extend longitudinally, and are spaced radially from each other with respect to the longitudinal axis of the produced coil. In this example, the coil is of polygonal configuration, more particularly of a square configuration, constituted of four equal sides.

Thus, electrically-conductive strip 10 is bent to define a square-shaped complete turn, including the four sides 11, 12, 13 and 14, respectively. Side 11 is formed with a diagonally-extending gap 15 which divides that side into two conductive sections 11*a*, 11*b* on opposite sides of the gap, such that section 11*a* of side 11, side 12, side 13, side 14, and section 11*b* of side 11, define a complete turn of the coil. Electrically-conductive section 11*a* is integrally formed with an outwardly projecting conductive terminal $T_1$ for the coil.

Conductive section 11*b* of side 11 is extended downwardly to define an extension 11*c* which overlies a portion of the second electrically-conductive strip 20. Extension 11*c* of conductive section 11*b* is further formed with a pair of openings 16, 17, described more particularly below. Openings 16 and 17 receive metal fasteners 41, 42 for electrically connecting conductive section 11*b* of electrically-conductive strip 10 to electrically-conductive strip 20. In addition, extension 11*c* of conductive section 11*b* is formed with a pair of legs 18, 19, which serve for mounting the electrical coil, as will also be described below.

The second electrically-conductive strip 20 defines a one-half turn of the coil. It is similarly of square configuration, but one side is left open. Thus, electrically-conductive strip 20 includes but three sides, 21, 22 and 23, alignable with sides 11, 12 and 13, respectively, in the assembled condition of the coil. Side 21 is extended to include an extension 21*a*, alignable with extension 11*c* of side 11 of strip 10. Extension 21*a* of strip 20 is further formed with a pair of openings 26, 27, alignable with openings 16, 17 of strip 10 for receiving fasteners 41, 42.

The opposite side 23 of strip 20 is integrally formed with an outwardly projecting connector terminal $T_2$, and with a pair of depending legs 28, 29. Legs 28, 29 are used with legs 18, 19 for mounting the coil. Connector terminal $T_2$ is used with terminal $T_1$ for making electrical connections to the so-produced coil.

The full winding defined by electrically-conductive strip 10, and the one-half winding defined by electrically-conductive strip 20, are insulated from each other by an electrically-insulative strip 30 interposed between the two conductive strips. As seen in FIG. 1, electrically-insulative strip 30 is bent to a corresponding square configuration as strips 10 and 20, except that strip 30 includes only three sides 31, 32, 33, as in the case of electrically-conductive strip 20. In addition, side 31 is cut at a diagonal corresponding to diagonal gap 15 in side 11 of electrically-conductive strip 10. The arrangement is such that when insulative strip 30 is mounted coaxially between the two conductive strips 10, 20, the flat faces of sides 11, 12, and 13 of conductive strip 10 are insulated from sides 21, 22 and 23 of conductive strip 20, except for conductive section 11*b* and extension 11*c* of side 11, which are exposed for direct contact with extension 21*a* of side 21 of conductive strip 20.

As indicated earlier, the two metal fasteners 41, 42, are receivable within holes 26, 27 of conductive strip 20 and holes 16, 17 of conductive strip 10 in the assembled condition of the coil. Metal fasteners 41, 42 thus enhance the electrical continuity between the turns of the two conductive strips 10, 20 produced by the electrical contact of conductive section 11*b*, and its extension 11*c*, of electrically-conductive strip 10 with side 21 and its extension 21*a* of electrically-conductive strip 20.

The two electrically-conductive strips 10, 20, and the electrically-insulative strip 30 inbetween, are all mounted coaxially on an insulating bobbin 43. Bobbin 43 (including the 1.5 turn coil defined by conductive strips 10, 20 and insulative strip 30 inbetween) is received within a magnetic core, generally designated 44. Magnetic core 44 includes: a center leg 45 for receiving bobbin 43 and the windings thereon; a pair of outer legs 46, 47 straddling bobbin 43 and the windings carried thereon; a first bridging leg 48 integrally formed at one end of the three legs 45–47; and another bridging leg 49 attachable to the other end of the three legs 46–47 in any suitable manner.

FIGS. 2 and 3 illustrate the electrical coil of FIG. 1 in its assembled condition, wherein terminal $T_1$ carried by side 11 of electrically-conductive strip 10 serves as one connector terminal, and terminal $T_2$ carried by side 23 of electrically-conductive strip 20 serves as the other terminal. Assuming the current flows from terminal $T_1$ to terminal $T_2$, it will be seen that the current flows clockwise for a full turn, via section 11*a*, sides 12, 13, 14, section 11*b* and its extension 11*c*, of conductive strip 10, and then clockwise for a one-half turn via extension 21*a* of side 21, and sides 22, 23 of conductive strip 20. It will also be seen that the electrically-insulative strip 30 insulates all the sides of conductive strip 10 from the corresponding sides of conductive strip 20, except for their aligned sides 11 and 21. Extensions 11*c* and 21*a* of the latter sides are left exposed by the insulative strip 30 so as to enable them to be bought into direct contact with each other, and thereby to establish electrical continuity between the two conductive strips 10, 20 of the coil. Metal fasteners 41, 42 received through the holes 16, 17 and 26, 27 in sides 11 and 21, respectively, enhance this electrical continuity between the two conductive strips 10 and 20.

It will thus be seen that the coil illustrated in FIGS. 1–3 extending between the two terminals $T_1$ and $T_2$ is constituted of 1.5 turns: one complete turn is defined by electrically-conductive strip 10 formed with terminal $T_1$, and one-half turn is defined by electrically-conductive strip 20 formed with terminal $T_2$.

Figure 4:
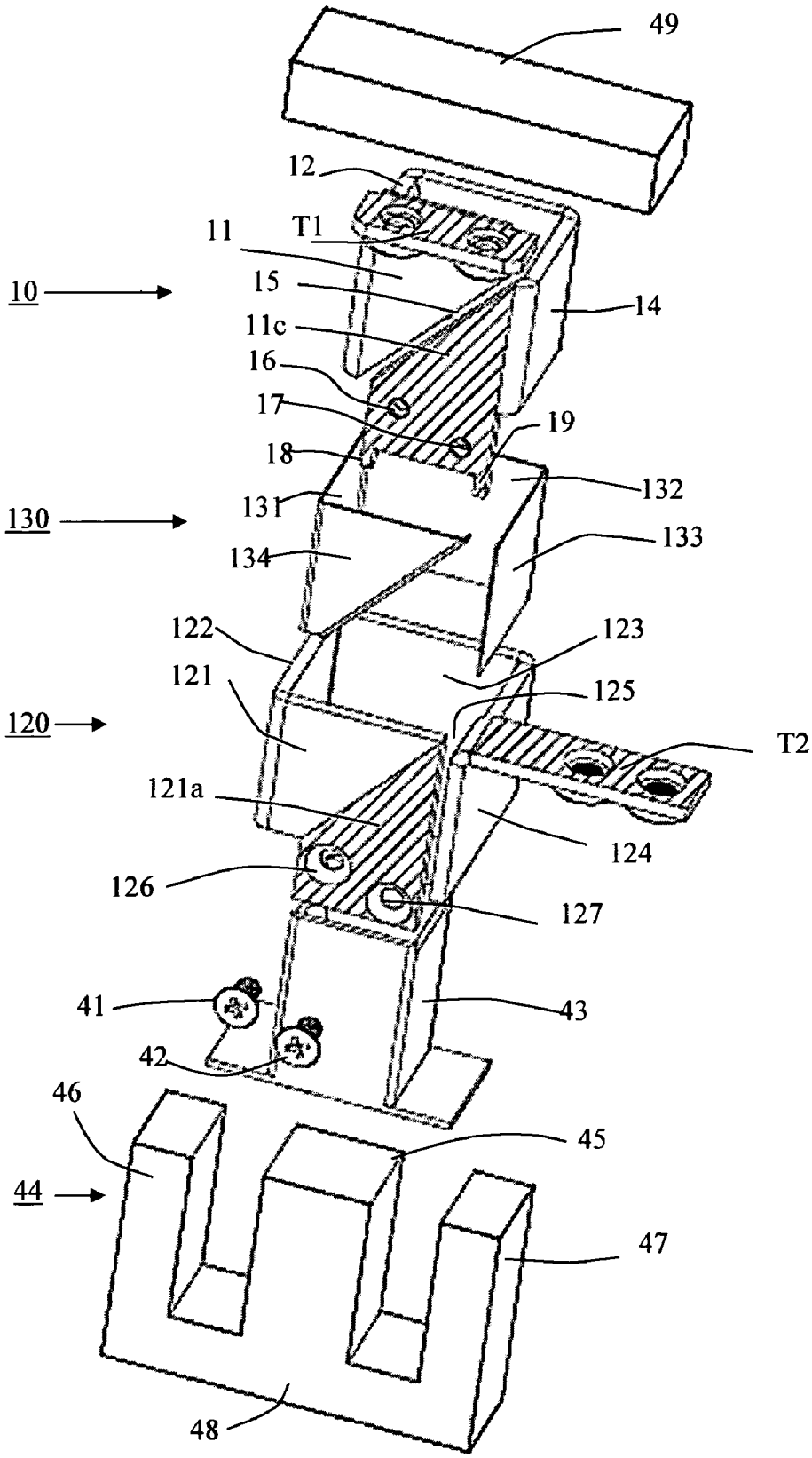
FIG. 4 is an exploded three-dimensional view illustrating a 2.0 turn electrical coil constructed in accordance with the present invention.
Figure 5:
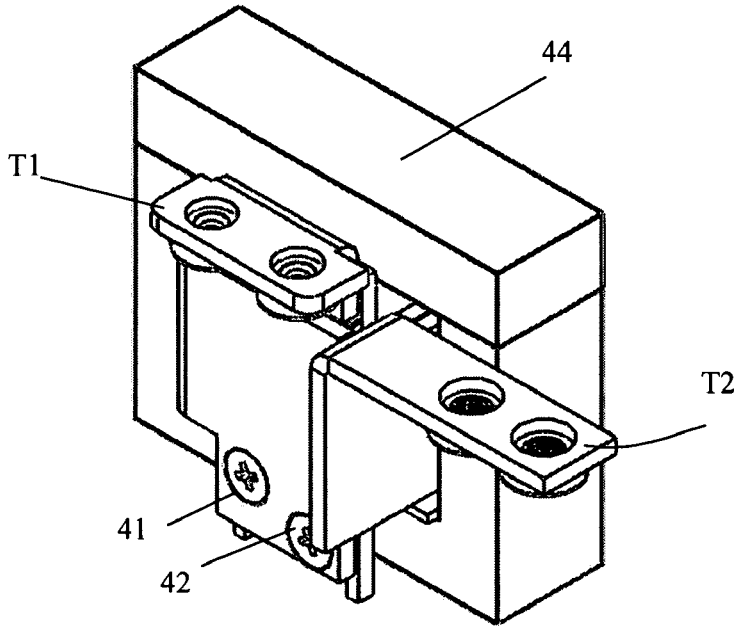
FIGS. 5 and 6 are views corresponding to those of FIGS. 2 and 3 of the 2.0 turn electrical coil of FIG. 4.
Figure 6:
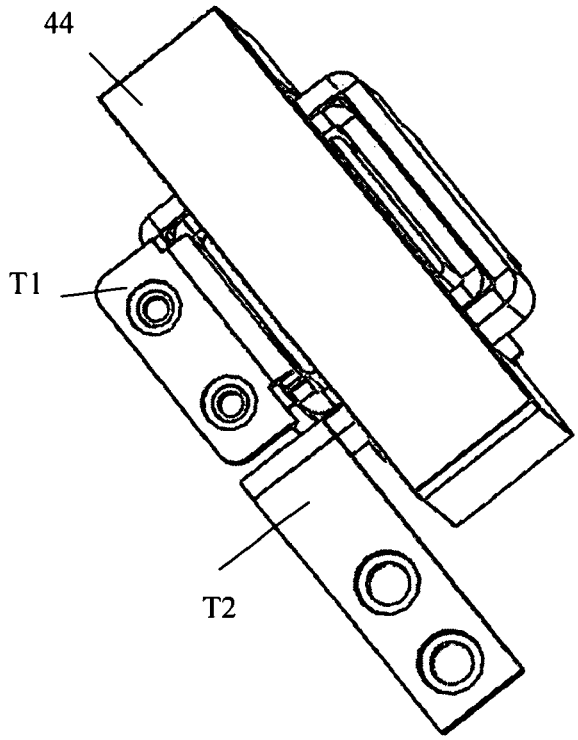

The 2.0 Turn Coil of FIGS. 4–6

FIGS. 4–6 illustrate a coil constructed in accordance the present invention to define 2.0 turns. It also includes but two flat, bent, electrically-conductive strips and a single electrically-insulative strip inbetween, as in FIGS. 1–3, except that the electrically-conductive strip of FIGS. 1–3 defining a one-half turn is modified to define a complete turn, and the electrically-insulative strip is modified to accommodate the extra one-half turn of the coil.

Thus, as shown particularly in FIG. 4, the first electrically-conductive strip is of the same construction as electrically-conductive strip 10 in FIG. 1; to facilitate understanding, the corresponding parts have therefore been identified by the same reference numerals. However, the second electrically-conductive strip is of a different construction, and is therefore generally designated 120 (rather than 20) in FIG. 4. The electrically-insulative strip in FIG. 4 has also been modified and is therefore generally designated 130 (rather than 30) in FIG. 4. The remainder of the coil illustrated in FIG. 4 is of the same construction as described above with respect to FIG. 1, and therefore the corresponding parts have been identified with the same reference numerals.

Electrically-conductive strip 120, modified to define a complete turn of the coil, is formed with four sides 121, 122, 123 and 124. Side 124 is integrally formed with the second connector terminal $T_2$ of the coil, and is separated from side 121 by a gap 125. Side 121 is formed with an extension 121*a* alignable with extension 11*c* of electrically-conductive strip 10 for producing electrical continuity between the turns defined by the two conductive strips 10 and 120. As in FIG. 1, the extension 121*a* in conductive strip 120 is formed with openings 126, 127, alignable with openings 16, 17, respectively, of extension 11*c* in conductive strip 10, for receiving the metal fasteners 41, 42 to enhance the electrical continuity between the turns defined by the two conductive strips 10 and 120.

The electrically-insulative strip 130, interposed between the two electrically-conductive strips 10 and 120, is similarly constructed as electrically-insulative strip 30 in FIG. 1, except that, instead of three sides, it includes four sides 131–134. The fourth side 134 is interposed between side 11 of strip 10 and side 121 of strip 120. It is cut at a diagonal so as to expose extension 11*c* of strip 10 to extension 121*a* of strip 120, to thereby establish electrical continuity between the turns defined by the two electrically-conductive strips.

It will thus be seen that the electrical coil between the two terminals $T_1$, $T_2$, is constituted of two full turns: one turn is defined by electrically-conductive strip 10, and a second turn is defined by electrically-conductive strip 120. It will also be seen that the two turns are electrically connected together in series via extensions 11*c* and 121*a* of the two conductive strips, and fasteners 41, 42 passing through these extensions.

As shown particularly in FIGS. 5 and 6, the two terminals $T_1$, $T_2$ are on the same side of the coil, rather than on opposite sides of the coil as in FIGS. 2 and 3.

Figure 7:
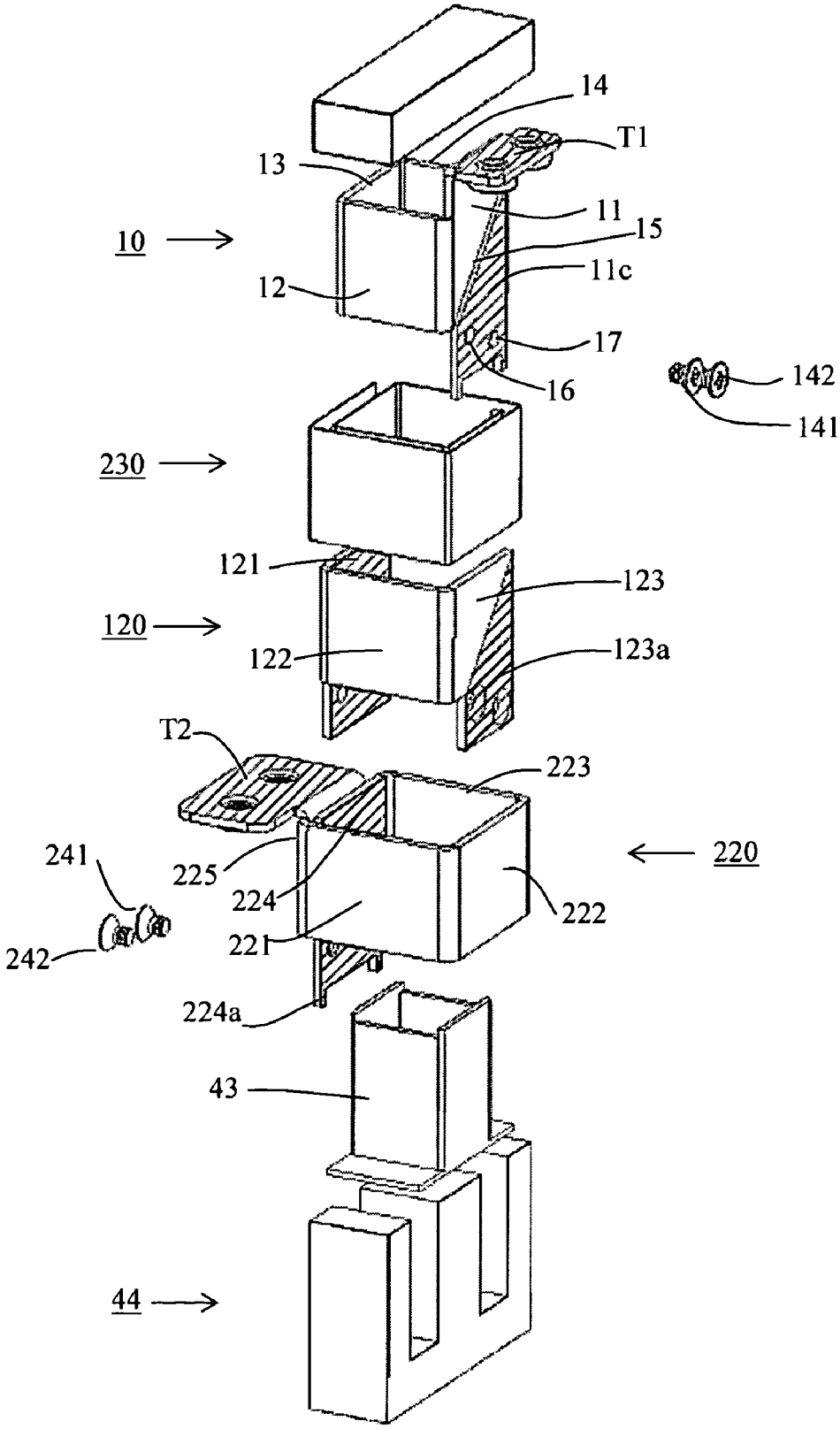
FIG. 7 is an exploded three-dimensional view illustrating a 2.5 turn electrical coil constructed in accordance with the present invention.
Figure 8:
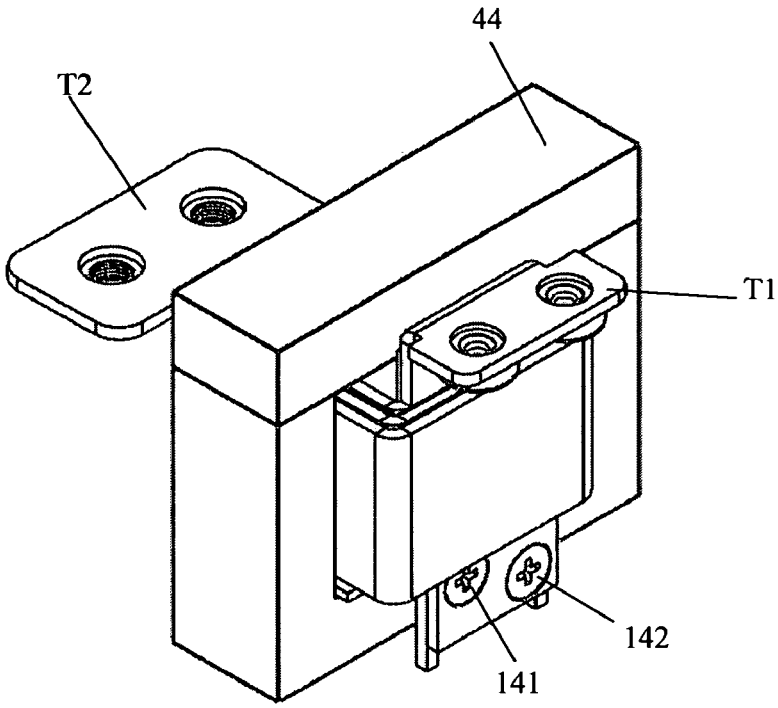
FIGS. 8 and 9 are views corresponding to those of FIGS. 2 and 3, respectively, of the 2.5 turn electrical coil of FIG. 7.
Figure 9:
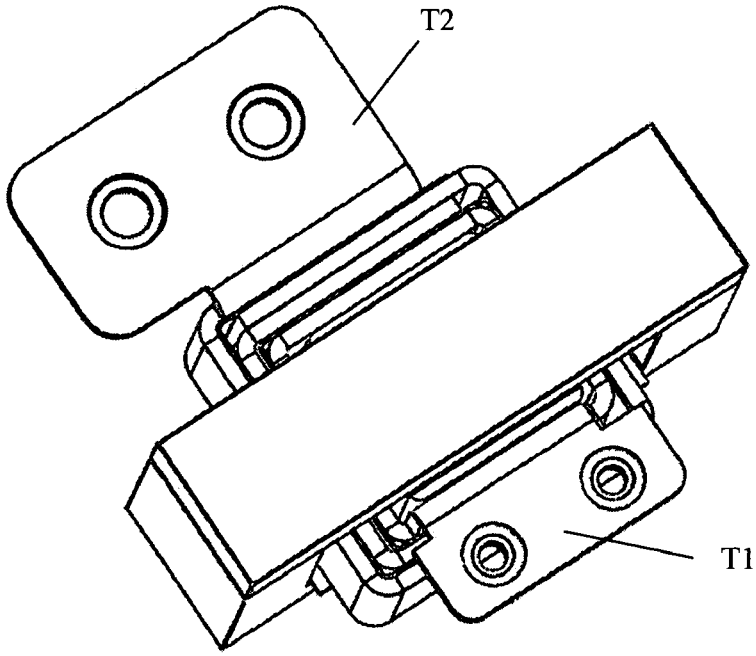

The 2.5 Turn Coil of FIGS. 7–9

As best seen in FIG. 7, the electrical coil of this embodiment includes first and second electrically-conductive strips 10 and 220 formed with the connector terminals $T_1$, $T_2$, respectively, with each strip defining a complete turn of the coil. The illustrated coil includes a further electrically-conductive strip, therein designated 240, between strips 10 and 220. Strip 240 is referred to below as an intermediate strip. It electrically connects the turns of the strip 10 and 220 together in series and defines a further one-half turn in the coil.

As in FIGS. 1 and 4, electrically-conductive strip 10 in FIG. 7 includes four sides 11–14, terminal $T_1$ integrally formed in side 11, and a gap 15 in side 11 dividing that side into two sections 11*a*, 11 *b*, the latter section 11*b* including an extension 11*c*. Electrically-conductive strip 220, however, is formed with five sides 221–225, with side 225 aligned with and spaced from side 224. Side 224 is formed with an extension 224*a*. One edge of side 225 is joined to side 224, and another edge of side 225 is integrally formed with terminal $T_2$.

The coil illustrated in FIG. 7 further includes an electrically-insulative strip 230 formed with seven sides 231–237 to be located between various sides of the three electrically-conductive strips 10, 240 and 220, as described more particularly below.

Intermediate conductive strip 240 includes three sides 241–243. Side 241 is formed with an extension 241*a* alignable with extension 224*a* in side 224 of conductive strip 220 to establish electrical continuity between strips 240 and 220. In addition, side 243 is formed with an extension 243*a* alignable with extension 11*c* of strip 10 to establish electrical continuity between strips 10 and 240.

The three electrically-conductive strips 10, 240 and 220 are assembled in coaxial relationship with each other, with strip 10 located inwardly and strip 220 located outwardly of the coaxial assembly. The electrically-insulative strip 230 is also included in the coaxial assembly, with the seven sides of insulative strip 230 located as follows: insulative side 231 is located between conductive sides 241 and 225; insulative side 232 is located between conductive sides 242 and 221; insulative side 233 is located between conductive sides 243 and 222; insulative side 234 is located between conductive side 223 and the open side of conductive strip 240; insulative side 235 is located between conductive sides 241 and 13; insulative side 236 is located between conductive sides 242 and 12; and insulative side 237 is located between conductive sides 243 and 11.

It will also be seen that the coil illustrated in FIG. 7 is assembled by the use of two pairs of metal fasteners, namely metal fasteners 151, 152 which are received through aligned openings in extensions 11*c* and 243*a* of conductive strips 10 and 240; and metal fasteners 153, 154, which are received within aligned openings in extensions 241*a* and 224*a* of conductive strips 240 and 220, respectively. Thus, when terminals $T_1$ and $T_2$ of the coil illustrated in FIG. 7 are connected to a voltage source such that the current flows from terminal $T_1$ to terminal $T_2$, conductive strip 10 will define a complete turn of the coil; conductive strip 240 will define a one-half turn of the coil connected to the full turn of coil 10 via extensions 11*c* and 243*a*; and conductive strip 220 will define a second full turn of the coil via extensions 241*a* and 224*a*, such that the resulting coil will have 2.5 turns.

While the invention has been described above with respect to coils having 1.5 turns, 2.0 turns and 2.5 turns, respectively, it will be appreciated that these merely represent preferred examples of the invention, and that coils having a different number of turns can be constructed according to the invention. For example, a larger number of turns can be provided be merely including one or more additional intermediate electrically-conductive strips, corresponding to strip 240, and the appropriate electrically-insulative strips to insulate adjacent sides of each strip from each other, except for their ends, in order to produce electrical continuity from each conductive strip to the next. It will also be appreciated that the electrically-conductive strips could be bent into other configurations than a square configuration. Many other variations, modifications, and applications of the invention will be apparent.

What is claimed is:

1. A high-current electrical coil, comprising:

a plurality of flat, electrically-conductive strips bent to define together a coil in which the electrically-conductive strips are disposed coaxially, extend longitudinally, and are spaced radially from each other, with respect to the longitudinal axis of the coil;

each of said electrically-conductive strips being bent to define at least a part of a turn of the coil;

a first one of said electrically-conductive strips having an outer end carrying a first connector terminal for the coil and projecting outwardly of the coil;

a second one of said electrically-conductive strips having an outer end carrying a second connector terminal for the coil and projecting outwardly of the coil;

each of said first and second electrically-conductive strips including inner ends in electrical continuity with each other, and intermediate portions electrically-insulated from each other such that the plurality of electrically-conductive strips together define a coil exceeding one turn between said first and second connector terminals.

2. The electrical coil according to claim 1, wherein the electrical coil further comprises electrically-conductive fasteners extending through the inner ends of said first and second electrically-conductive strips to enhance said electrical continuity between said inner ends thereof.

3. The electrical coil according to claim 1, wherein each of said first and second electrically-conductive strips is formed with mounting legs depending from the end thereof opposite to that carrying the respective connector terminal.

4. The electrical coil according to claim 1, wherein said plurality of electrically-conductive strips are bent to define a polygon of equal sides.

5. The electrical coil according to claim 4, wherein one side of one of said electrically-conductive strips is formed with a gap defining first and second conductive sections on opposite sides of the gap; said first conductive section being integrally formed with one of said connector terminals of the coil; said second conductive section being in electrical continuity with the other electrically conductive strip carrying said other connector terminal of the coil.

6. The electrical coil according to claim 5, wherein said gap extends diagonally of said one side of said one electrically-conductive strip.

7. The electrical coil according to claim 4, wherein one side of one of said electrically-conductive strips is integrally formed with one of said connector terminals, and is spaced by a gap from another side of the respective electrically-conductive strip in electrical continuity with the electrically-conductive strip carrying said other connector terminal.

8. The electrical coil according to claim 1, wherein said plurality of electrically-conductive strips include only said first and second electrically-conductive strips.

9. The electrical coil according to claim 8, wherein said intermediate portions of the electrically-conductive strips are electrically insulated form each other by an electrically-insulative strip interposed between said electrically conductive strips and bent to insulate said intermediate portions thereof from each other but to expose said inner ends thereof for contact with each other in order to provide said electrical continuity between said electrically-conductive strips.

10. The electrical coil according to claim 9, wherein one of said electrically-conductive strips is bent to define one-half of a complete turn of the coil, and the other electrically-conductive strip is bent to define a complete turn of the coil, such that the coil includes 1.5 turns.

11. The electrical coil according to claim 9, wherein each of said electrically-conductive strips is bent to define a complete turn of the coil such that the coil includes 2.0 turns.

12. The electrical coil according to claim 1, wherein said plurality of electrically-conductive strips further include at least one intermediate electrically-conductive strip coaxially disposed between said first and second electrically-conductive strips, said intermediate electrically-conductive strip having opposite ends in electrical continuity with the inner ends of said first and second electrically-conductive strips, and an intermediate portion electrically insulated from said first and second electrically-conductive strips.

13. The electrical coil according to claim 12, wherein said intermediate portion of the intermediate electrically-conductive strip is electrically insulated from each of said first and second electrically-conductive strips by an electrically-insulative strip.

14. The electrical coil according to claim 12, wherein the electrical coil further comprises electrically-conductive fasteners extending through the ends of said intermediate electrically-conductive strip and the ends of the first and second electrically-conductive strips to enhance said electrical continuity.

15. The electrical coil according to claim 12, wherein each of said first and second electrically-conductive strips is bent to define a complete turn of the coil, and said intermediate electrically-conductive strip is bent to define a half turn of the coil, such that the coil includes 2.5 turns.

16. The electrical coil according to claim 15, wherein each of said first and second electrically-conductive strips is bent into a rectangular configuration of four sides defining a complete turn, and said intermediate electrically-conductive strip is bent into a configuration including three sides defining a one-half turn.

17. The electrical coil according to claim 16, wherein said electrical coil further comprises an electrically-insulative strip bent into a rectangular configuration corresponding to the rectangular configuration of said first and second electrically-conductive strips; said electrically-insulative strip being formed with seven sides, in which four sides define said rectangular configuration, and three sides are aligned with and spaced from three of said four sides.

18. The electrical coil according to claim 1, wherein said plurality of electrically-conductive strips are bent into a square configuration.

19. The electrical coil according to claim 1, wherein said electrical coil further includes a magnetic core and a bobbin thereover on which said plurality of electrically-conductive strips are coaxially mounted.

* * * * *